US008342666B2

(12) United States Patent
Lee et al.

(10) Patent No.: US 8,342,666 B2
(45) Date of Patent: Jan. 1, 2013

(54) INK-JET IMAGE FORMING APPARATUS AND METHOD OF CONTROLLING INK FLOW

(75) Inventors: Jae Yun Lee, Seoul (KR); Jin Ho Park, Yongin-si (KR); Sung Wook Kang, Seoul (KR); Young Su Lee, Suwon-si (KR); In Su Lee, Suwon-si (KR); Il Ju Mun, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 1214 days.

(21) Appl. No.: 12/132,025

(22) Filed: Jun. 3, 2008

(65) Prior Publication Data

US 2009/0109267 A1 Apr. 30, 2009

(30) Foreign Application Priority Data

Oct. 29, 2007 (KR) ..... 10-2007-0108919

(51) Int. Cl.
*B41J 29/38* (2006.01)

(52) U.S. Cl. ..... 347/89; 347/17

(58) Field of Classification Search ..... 347/84, 347/85, 89, 17
See application file for complete search history.

(56) References Cited

U.S. PATENT DOCUMENTS

| | | | | |
|---|---|---|---|---|
| 4,380,770 | A * | 4/1983 | Maruyama | 347/29 |
| 4,680,696 | A * | 7/1987 | Ebinuma et al. | 347/85 |
| 5,220,345 | A * | 6/1993 | Hirosawa | 347/17 |
| 6,082,851 | A * | 7/2000 | Shihoh et al. | 347/85 |
| 6,152,559 | A * | 11/2000 | Kojima | 347/89 |
| 6,231,174 | B1 * | 5/2001 | Haigo | 347/89 |
| 6,250,747 | B1 * | 6/2001 | Hauck | 347/86 |
| 6,357,867 | B1 | 3/2002 | Hine | |
| 2002/0047882 | A1 * | 4/2002 | Karlinski et al. | 347/85 |
| 2002/0196316 | A1 * | 12/2002 | Nakamura | 347/84 |
| 2003/0142184 | A1 * | 7/2003 | Haines et al. | 347/92 |
| 2007/0081052 | A1 * | 4/2007 | Lebron et al. | 347/84 |
| 2007/0206075 | A1 * | 9/2007 | Bulman et al. | 347/86 |
| 2007/0279461 | A1 * | 12/2007 | Hiratsuka et al. | 347/85 |
| 2009/0109267 | A1 * | 4/2009 | Lee et al. | 347/89 |

FOREIGN PATENT DOCUMENTS

| | | | |
|---|---|---|---|
| DE | 2916881 | A * | 11/1979 |
| JP | 2006088492 | A * | 4/2006 |

* cited by examiner

*Primary Examiner* — Charlie Peng
*Assistant Examiner* — Peter Radkowski
(74) *Attorney, Agent, or Firm* — Stanzione & Kim, LLP

(57) ABSTRACT

An ink-jet image forming apparatus. The ink-jet image forming apparatus includes a print head having a plurality of nozzles to eject ink, an ink tank to store the ink, an ink supply passage to supply the ink in the ink tank to the print head, an ink return passage to return the ink in the print head to the ink tank, a regulator mounted in the ink supply passage to regulate ink flow supplied to the print head, a shut-off valve mounted in the ink supply passage, between the ink tank and the regulator, to intercept ink flow supplied to the regulator, and an ink pump mounted in the ink return passage to forcedly flow the ink in the ink return passage. The ink pump is configured to be driven in forward and reverse directions so as to change an ink flow direction. Since the shut-off valve intercepts forcedly the ink flow in the ink supply passage, the ink in the ink tank is prevented from flowing abnormally to the print head and leaking from the print head.

18 Claims, 6 Drawing Sheets

INK-JET IMAGE FORMING APPARATUS AND METHOD OF CONTROLLING INK FLOW

CROSS-REFERENCE TO RELATED APPLICATIONS

This application claims the benefit of Korean Patent Application No. 2007-0108919, filed on Oct. 29, 2007 in the Korean Intellectual Property Office, the disclosure of which is incorporated herein by reference in its entirety.

BACKGROUND OF THE INVENTION

1. Field of the Invention

The present general inventive concept relates to an ink-jet image forming apparatus, and more particularly, to an ink-jet image forming apparatus and a method of controlling ink flow, which can decrease a risk of ink leakage through a print head and can easily remove foreign substances from the print head.

2. Description of the Related Art

An image forming apparatus is an apparatus that prints a black and white image or a color image on a printing medium, e.g., paper, according to an image signal, for example, a laser printer, an ink-jet printer, a copying machine, a multi-function printer, a fax machine, etc. An image forming apparatus is classified as an electrophotographic type in which a beam is scanned onto a photosensitive body to form an electrostatic latent image and a developer is adhered to the electrostatic latent image to transfer the same onto a printing medium, or an ink-jet type in which a liquid type ink is ejected onto a surface of a printing medium according to an image signal.

Of the above described types of image forming apparatuses, the ink-jet image forming apparatus is provided with a print head which ejects ink according to an image signal. By the print head ejecting an ink droplet according to an image signal, an image, such as letters or pictures, are printed on a printing medium. The ink-jet image forming apparatus is classified as a shuttle type in which a print head ejects ink while reciprocatingly moving in a direction (a width direction of a printing medium) perpendicular to a printing medium conveying direction, or an array type in which a print head having a length corresponding to a width of a printing medium is fixedly mounted above a printing medium conveying path to achieve line printing.

In such an ink-jet image forming apparatus, when ink is ejected from nozzles of the print head according to an image signal, ink stored in an ink tank is automatically supplied to the print head, and thus the print head can eject the ink successively. If an excessive amount of ink is supplied to the print head during a printing operation, or if the ink is supplied to the print head during a non-printing operation, a so-called wetting phenomenon may occur, in which the ink leaks out on a surface of the print head irrespectively of the printing operation. To prevent this problem, a regulator is mounted between the print head and the ink tank, which regulates ink flow so that the optimum amount of ink is supplied to the print head from the ink tank only when the ink is ejected from the print head.

FIG. 1 is a schematic view of a conventional ink-jet image forming apparatus, which illustrates only a print engine part to print an image on a printing medium by ejecting ink.

As illustrated in FIG. 1, a conventional ink-jet image forming apparatus includes a print head 11 having a plurality of nozzles (not shown) to eject ink, an ink tank 13 to store ink, a regulator 12 mounted between the print head 11 and the ink tank 13 to regulate ink flow, and an ink pump 14 to force ink to flow between the print head 11 and the ink tank 13.

In such a conventional ink-jet image forming apparatus, when the ink is ejected from the print head 11 according to an image signal, a passage in the regulator 12 is opened, and the ink in the ink tank 13 is supplied to the print head 11 through the regulator 12. In a non-printing operation state, the regulator 12 blocks the ink flow, and thus the ink in the print head 11 is prevented from flowing out of the print head 11. The ink pump 14 forcedly circulates the ink through the print head 11, the ink tank 13 and the regulator 12, thereby preventing the ink in the apparatus from becoming dry and hard.

However, in the above-described conventional ink-jet image forming apparatus, because the ink tank and the regulator are mounted above the print head, a positive pressure is always generated above the regulator. Therefore, when the regulator is left as it is for a long period of time, or when the regulator operates erroneously or is damaged, the ink in the ink tank may flow down to the print head, which results in leakage of the ink from the print head.

Also, the conventional ink-jet image forming apparatus has a problem such that it is difficult to remove air and dust existing in the print head 11 by discharging them to the outside. Because the ink pump 14 has only the function of circulating the ink, though the ink forcedly flows by the operation of the ink pump 14, it is difficult to remove foreign substances from the print head 11.

SUMMARY OF THE INVENTION

The present general inventive concept provides an ink-jet image forming apparatus and a method of controlling ink flow, which can decrease a risk of ink leakage through a print head and can easily remove air or dust from the print head.

Additional aspects and/or utilities of the present general inventive concept will be set forth in part in the description which follows and, in part, will be obvious from the description, or may be learned by practice of the general inventive concept.

The foregoing and/or other aspects and utilities of the present general inventive concept can be achieved by providing an ink-jet image forming apparatus including a print head having a plurality of nozzles to eject ink, an ink tank to store the ink, an ink supply passage to supply the ink in the ink tank to the print head, an ink return passage to return the ink in the print head to the ink tank; a regulator mounted in the ink supply passage to regulate ink flow supplied to the print head, a shut-off valve mounted in the ink supply passage, between the ink tank and the regulator, to intercept ink flow supplied to the regulator, and an ink pump mounted in the ink return passage to forcedly flow the ink in the ink return passage, the ink pump being configured to be driven in forward and reverse directions so as to change an ink flow direction.

The print head may be positioned higher than a maximum level of the ink stored in the ink tank.

The ink-jet image forming apparatus may further include a filter mounted between the ink tank and the shut-off valve to filter foreign substances included in the ink flowing along the ink supply passage.

The ink tank may be provided with an air vent to introduce outside air.

When the shut-off valve blocks the ink supply passage and the ink pump is driven in the reverse direction, the ink in the ink tank may flow to the print head, and the ink in the print head may be ejected through the plurality of nozzles. Thereby, foreign substances existing in the print head are discharged outside together with the ejected ink.

When the shut-off valve opens the ink supply passage and the ink pump is driven in the forward direction, the ink may circulate between the print head and the ink tank.

The ink pump may be configured as a rotary pump capable of rotating in the forward and reverse directions.

The shut-off valve may include a valve seat having an orifice connecting a passage at a side of the ink tank and a passage at a side of the regulator, an opening/closing member to open or close the orifice, and a cam to operate the opening/closing member.

The regulator may include an ink chamber connected with the print head, a valve seat having an orifice connecting the ink chamber and a passage at a side of the shut-off valve, and an opening/closing member to open or close the orifice by moving according to a pressure change in the ink chamber.

The foregoing and/or other aspects and utilities of the present general inventive concept can also be achieved by providing a method of controlling ink flow in an ink-jet image forming apparatus including a shut-off valve provided in an ink supply passage, through which ink in an ink tank is supplied to a print head, to intercept ink flow, and an ink pump provided in an ink return passage, through which ink in the print head returns to the ink tank, to forcedly flow the ink, the method including blocking the ink supply passage by closing the shut-off valve, and discharging foreign substances outside from the print head together with the ejected ink, by driving the ink pump in a reverse direction to forcedly flow the ink in the ink tank to the print head through the ink return passage.

The foregoing and/or other aspects and utilities of the present general inventive concept can also be achieved by providing a method of controlling ink flow in an ink-jet image forming apparatus including a shut-off valve provided in an ink supply passage, through which ink in an ink tank is supplied to a print head, to intercept ink flow, and an ink pump provided in an ink return passage, through which ink in the print head returns to the ink tank, to forcedly flow the ink, the method including opening the ink supply passage by opening the shut-off valve, and circulating the ink between the print head and the ink tank by driving the ink pump in a forward direction.

The foregoing and/or other aspects and utilities of the present general inventive concept can also be achieved by providing a method of controlling ink flow in an ink-jet image forming apparatus including a print head having a plurality of nozzles to eject ink, an ink tank to store the ink, and an ink supply passage and an ink return passage to connect the print head and the ink tank, the method including blocking the ink supply passage, and discharging foreign substances outside from the print head through the plurality of nozzles by forcedly flowing the ink in the ink tank to the print head through the ink return passage.

The foregoing and/or other aspects and utilities of the present general inventive concept can also be achieved by providing an ink-jet image forming apparatus including a print head to eject ink, an ink storage to store the ink, an ink transportation loop to supply the ink in the ink storage to the print head and to return the ink in the print head to the ink storage, a regulator mounted in the ink transportation loop to regulate ink flow supplied to the print head from the ink storage, a shut-off valve mounted in the ink transportation loop between the ink storage and the regulator to intercept ink flow supplied to the regulator, and a reversible ink pump mounted in the ink transportation loop between the print head and the ink storage to forcedly flow the ink from the print head to the ink storage and to forcedly flow the ink from the ink storage to the print head based on a mode of operation of the ink-jet image forming apparatus.

When a purging operation of the print head is being performed, the shut-off valve closes, the ink pump is driven in a first direction to flow ink directly from the ink storage to the print head, and pressure of the regulator increases.

When a circulation operation of ink is being performed, the shut-off valve opens, the ink pump is driven in a second direction to flow ink from the ink storage to the print head through the shut-off valve and the reversible ink pump, and pressure of the regulator decreases.

When a printing operation is being performed, the shut-off valve is in an open state, the ink pump is in a non-operating state, and pressure of the regulator decreases while supplying ink to the print head.

The regulator can include a pressure device which opens an orifice between the regulator and the ink storage to allow ink to flow from the ink storage to the regulator while ink also flows from the regulator to the print head during a printing operation, and closes the orifice as the regulator builds up a supply of ink when the printing operation is completed.

The pressure device can include an airbag that expands when the pressure within the regulator decreases and contracts when the pressure within the regulator increases, and an operation device which opens the orifice when the airbag expands and closes the orifice when the airbag contracts.

BRIEF DESCRIPTION OF THE DRAWINGS

These and/or other aspects and utilities of the exemplary embodiments of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
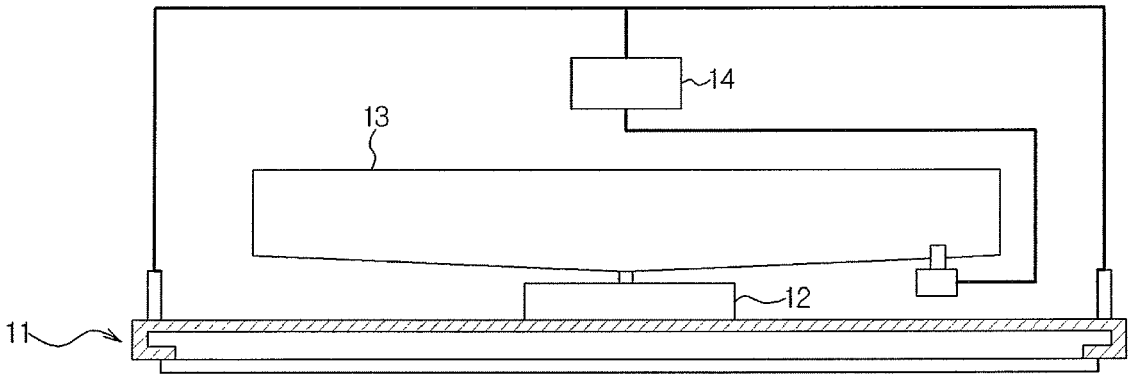
FIG. 1 (RELATED ART)
FIG. 1 is a constitutional view schematically illustrating a conventional ink-jet image forming apparatus.

Reference will now be made in detail to exemplary embodiments of the present general inventive concept, examples of which are illustrated in the accompanying drawings, wherein like reference numerals refer to like elements throughout. The embodiments are described below to explain the present general inventive concept by referring to the figures.

Figure 2:
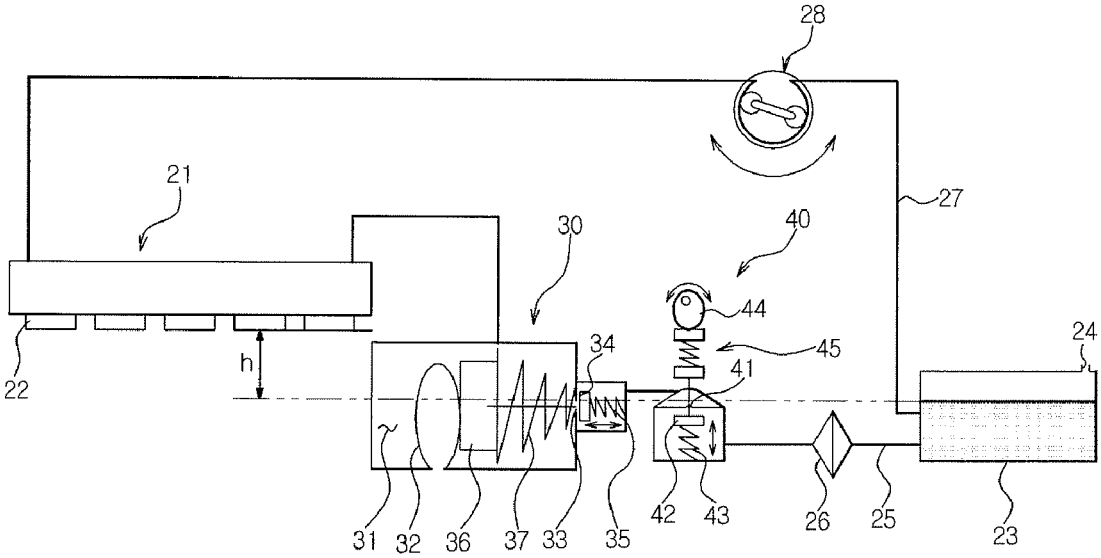
FIG. 2 is a constitutional view schematically illustrating an ink-jet image forming apparatus according to an exemplary embodiment of the present general inventive concept.

FIG. 2 is a schematic view of an ink-jet image forming apparatus according to an exemplary embodiment of the present general inventive concept, which illustrates only a print engine part to print an image on a printing medium by ejecting ink.

As illustrated in FIG. 2, an ink-jet image forming apparatus according to the present embodiment includes a print head 21 to eject ink, an ink tank 23 to store ink, an ink supply passage 25 to connect the print head 21 and the ink tank 23, an ink return passage 27 to connect the print head 21 and the ink tank 23 separately from the ink supply passage 25, a regulator 30 mounted in the ink supply passage 25, a shut-off valve 40 mounted between the ink tank 23 and the regulator 30, and an ink pump 28 mounted in the ink return passage 27. In FIG. 2, the illustration of a control device to control operations of the above components was omitted for brevity of the description of the invention.

The print head 21 has a plurality of head chips 22 connected with the ink supply passage 25 and the ink return passage 27, through which the ink can flow. Each of the head chips 22 is provided with a plurality of nozzles (not shown) to eject the ink.

The ink tank 23 is connected with the ink supply passage 25 and the ink return passage 27. The ink supply passage 25 is connected to a relatively lower portion of the ink tank 23, and the ink return passage 27 is connected to a relatively upper portion of the ink tank 23. The ink tank 23 is provided with an air vent 24 at a top thereof, through which air can flow between the internal space of the ink tank 23 and the external.

The regulator 30 regulates the ink flow supplied to the print head 21 so that the ink can be supplied to the print head 21 only when the ink flows out of the print head 21. The regulator 30 has an ink chamber 31, in which ink is filled. The regulator 30 draws the ink in the print head 21 by use of a suitable negative pressure generated in the ink chamber 31, thereby preventing the ink in the print head 21 from leaking through the nozzles.

The regulator 30 includes an air bag 32 mounted in the ink chamber 31 and communicating with the outside to permit the air flow to/from the outside, and an opening/closing member 34 to open or close an orifice 33 connecting the ink chamber 31 and the passage extending to the shut-off valve 40. The opening/closing member 34 is elastically supported and pressed by a press spring 35, to block the orifice 33. When the air bag 32 is expanded, the opening/closing member 34 opens the orifice 33. Between the air bag 32 and the opening/closing member 34 are mounted an operating member 36, which moves by a contraction/expansion of the air bag 32, and a return spring 37, which pushes the operating member 36 toward the air bag 32. When the air bag 32 is expanded, the operating member 36 moves toward the opening/closing member 34, and pushes the opening/closing member 34. Thereby, the orifice 33 is opened. When the air bag 32 is contracted, the press spring 35 pushes the opening/closing member 34. Thereby, the orifice 33 is closed.

The shut-off valve 40 is mounted in the ink supply passage 25, between the ink tank 23 and the regulator 30, and intercepts the ink flow through the ink supply passage 25. The shut-off valve 40 includes an orifice 41, which connects the passage at the side of the ink tank 23 and the passage at the side of the regulator 30, and an opening/closing member 42, which opens and closes the orifice 41. The opening/closing member 42 is pressed toward the orifice 41 by a press spring 43, to block the orifice 41. The opening operation of the orifice 41 is performed by a cam 44 and an operating member 45. When the cam 44 rotates to push the operating member 45, the operating member 45 separates the opening/closing member 42 from the orifice 41. Thereby, the orifice 41 becomes opened.

In the present embodiment, the shut-off valve 40 is not limited to the above-described structure, and can be varied diversely. That is, various types of valves, such as a solenoid valve, capable of intercepting the ink flow through the ink supply passage 25 can be used as the shut-off valve 40.

The ink pump 28 is mounted in the ink return passage 27 to forcedly flow the ink through the ink return passage 27. The ink pump 28 can be driven in a forward direction to flow the ink within the print head 21 to the ink tank 23 through the ink return passage 27, and also can be driven in a reverse direction to flow the ink within the ink tank 23 to the print head 21 through the ink return passage 27. The ink pump 28 has a circulation effect of making concentration of the ink in the apparatus uniform by circulating the ink between the ink tank 23 and the print head 21, and also has a purging effect of discharging foreign substances from the print head 21 by forcedly flowing the ink to the print head 21 through the ink return passage 27.

That is, when the ink pump 28 is driven in the forward direction while the shut-off valve 40 is opened, the ink within the ink tank 23 flows to the print head 21 through the ink supply passage 25, and the ink within the print head 21 flows to the ink tank 23 through the ink return passage 27. Thus, the ink is mixed evenly in the whole apparatus. Accordingly, a problem of gathering of the ink in a specific portion of the apparatus, solidification of the ink and/or an increase of concentration of the ink can be avoided. When the ink pump 28 is driven in the reverse direction while the shut-off valve 40 is closed, the ink in the ink return passage 27 flows forcedly to the print head 21, and foreign substances, such as air and dust, which may be existing in the print head 21, are discharged to the outside of the print head 21 by being mixed in the ink that is ejected through the nozzles.

In this embodiment, the ink pump 28 is configured as a rotary pump, which can be rotated in forward and reverse directions. However, the ink pump 28 is not limited to the rotary pump, but various types of pumps capable of forcedly flowing the ink and changing the flow direction of the ink can be used as the ink pump 28.

In addition, the ink-jet image forming apparatus according to the present embodiment may also include a filter 26 mounted in the ink supply passage 25. The filter 26 is mounted between the ink tank 23 and shut-off valve 40, and filters foreign substances included in the ink flowing toward the print head 21.

The print head 21 is arranged at a position higher than a level of the ink stored in the ink tank 23. When a lowermost portion of the print head 21, i.e., a lower end of the head chip 22 is arranged higher than the level of the ink stored in the ink tank 23 by a predetermined height (h), the print head 21 is not subjected to a positive pressure from the ink stored in the ink tank 23, and accordingly a risk of ink leakage through the nozzles can be further decreased. It is also preferred that the regulator 30 is arranged lower than the print head 21.

Hereinafter, an operation of the ink-jet image forming apparatus according to an embodiment of the present general inventive concept will be described with reference to FIGS. 3A to 3C.

Figure 3A:
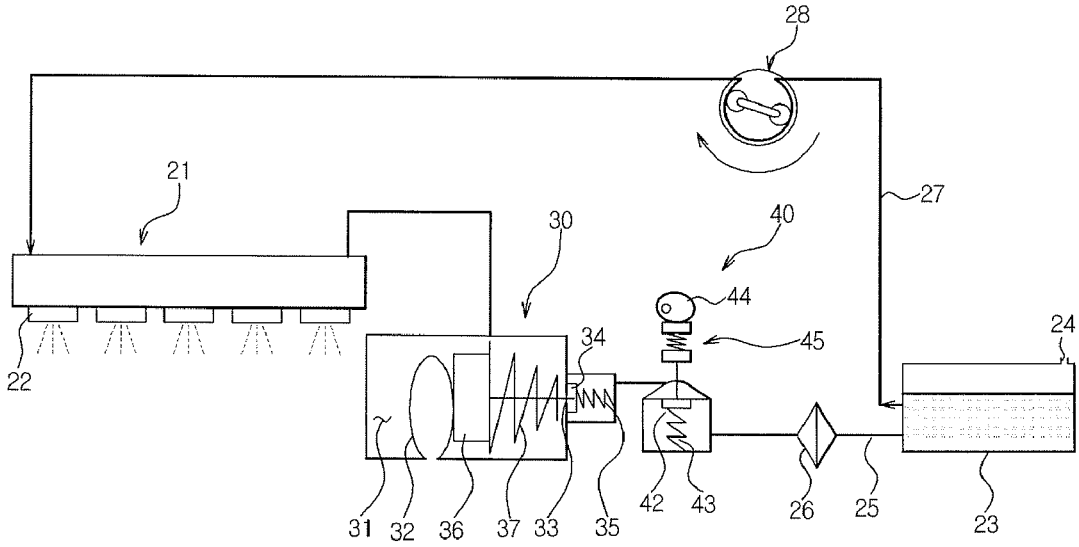
FIG. 3A illustrates a purging operation of the ink-jet image forming apparatus according to an exemplary embodiment of the present general inventive concept.

FIG. 3A illustrates a purging operation to remove foreign substances from the print head 21. During the purging operation, the shut-off valve 40 is in a closed state. When the ink pump 28 is driven in the reverse direction while the shut-off valve 40 intercepts the ink flow through the ink supply passage 25, the ink in the ink tank 23 flows in the ink return passage 27, and the ink in the ink return passage 27 flows forcedly to the print head 21. If the ink flows in the print head 21, the ink is ejected through the plurality of nozzles, and at the same time foreign substances, such as air and/or dust, which may be existing in the print head 21, are discharged to the outside of the print head 21 together with the ejected ink.

At this time, the ink in the print head 21 cannot flow to the regulator 30 because of the pressure in the ink chamber 31, and the ink flow through the ink supply passage 25 does not occur.

Figure 3B:
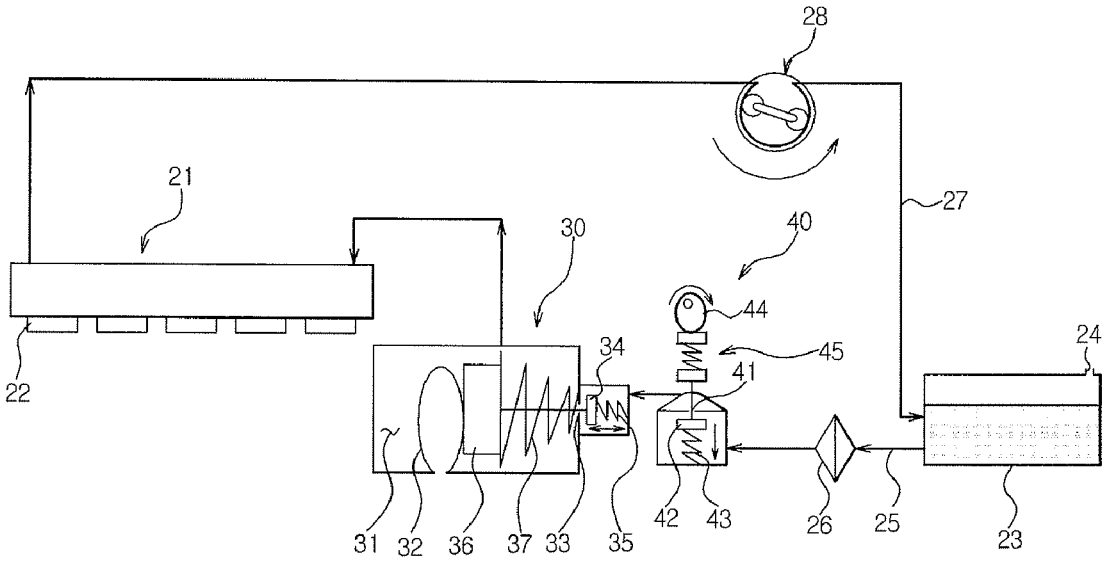
FIG. 3B illustrates a circulation operation of the ink-jet image forming apparatus according to an exemplary embodiment of the present general inventive concept.

FIG. 3B illustrates a circulation operation to circulate the ink in the apparatus. During the circulation operation, the shut-off valve 40 is in an opened state. When the ink pump 28 is driven in the forward direction while the shut-off valve 40 is opened, the ink in the ink tank 23 flows to the print head 21 through the ink supply passage 25, via the filter 26, the shut-off valve 40 and the regulator 30, and the ink within the print head 21 flows in the ink tank 23 through the ink return passage 27, via the ink pump 28. As such, the ink circulates between the ink tank 23 and the print head 21, and accordingly the ink maintains a uniform concentration in the whole apparatus.

Figure 3C:
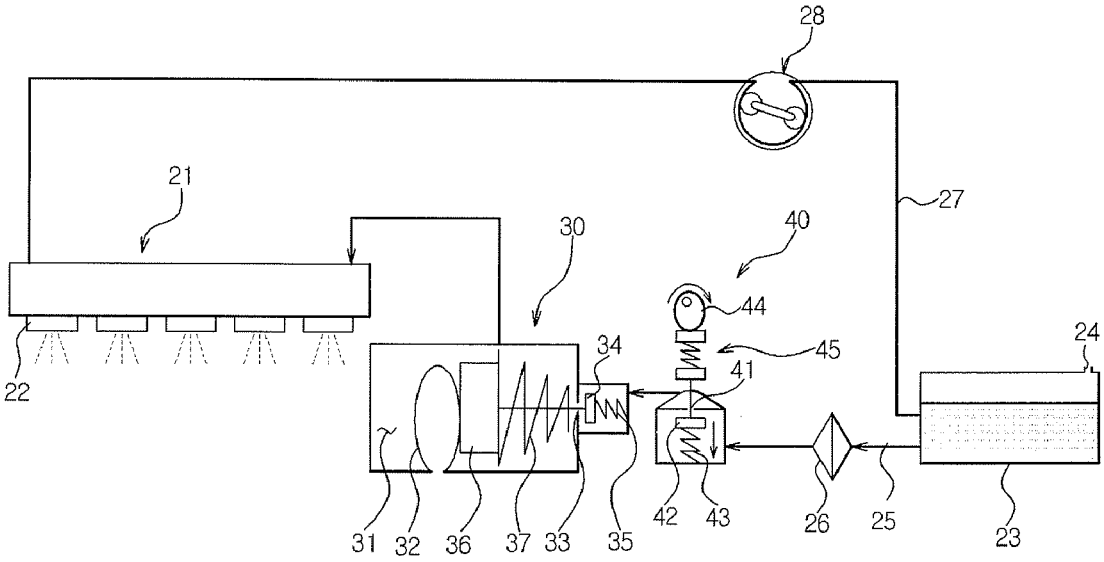
FIG. 3C illustrates a printing operation of the ink-jet image forming apparatus according to an exemplary embodiment of the present general inventive concept.

FIG. 3C illustrates a printing mode, in which the print head 21 ejects the ink corresponding to an image signal. During the printing mode, the shut-off valve 40 is in an opened state, and the ink pump 28 is in a non-operating state. If a printing command is input, the print head 21 ejects the ink corresponding to an image signal. If the ink is ejected, an ink pressure in the print head 21 drops, and the ink within the regulator 30 flows in the print head 21 due to a pressure difference therebetween. If the ink within the regulator 30 flows to the print head 21, an ink pressure in the regulator 30 drops, and the air bag 32 becomes expanded. Then, the operating member 36 pushes the opening/closing member 34, and the orifice 33 in the regulator 30 is opened. When the orifice 33 is opened, the ink within the ink tank 23 flows in the ink chamber 31 of the regulator 30 due to the pressure difference therebetween. Thereafter, the pressure in the ink chamber 31 rises, so that the air bag 32 becomes contracted, and the opening/closing member 34 blocks the orifice 33.

As such, while the ink is ejected from the print head 21, the opening/closing member 34 of the regulator 30 repeats the operations of opening and closing the orifice 33, and thereby regulates the ink flow supplied to the print head 21.

When the printing mode is terminated, the cam 44 is rotated so that the opening/closing member 42 of the shut-off valve 40 blocks the orifice 41, thereby intercepting the ink flow through the ink supply passage 25. Accordingly, even when the regulator 30 operates erroneously or is damaged, the ink in the ink tank 23 is prevented from flowing to the print head 21.

As described above, the ink-jet image forming apparatus according to the above described embodiments are constituted such that the shut-off valve 40 mounted in the ink supply passage 25, between the ink tank 23 and the regulator 30, intercepts the ink flow through the ink supply passage 25. Accordingly, even when the regulator 30 operates erroneously or is damaged, the ink in the ink tank 23 is prevented from flowing in the print head 21 and leaking from the print head 21.

Further, if the ink pump 28 is driven in the reverse direction while the shut-off valve 40 blocks the ink supply passage 25, foreign substances existing in the print head 21 are discharged to the outside through the print head 21 together with the ejected ink. Accordingly, the ink-jet image forming apparatus according to the above described embodiments has an effect of easily removing foreign substances from the print head 21.

Figure 4:
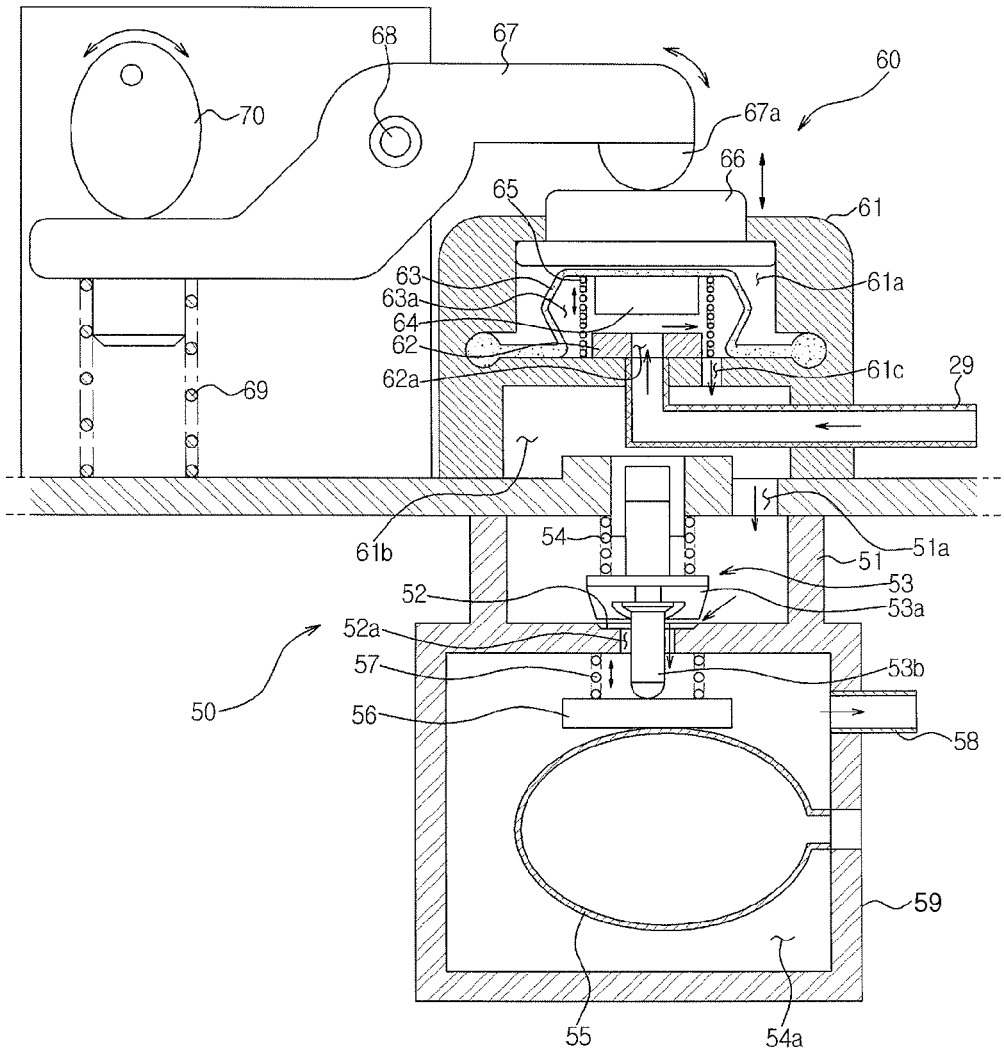
FIG. 4 is a sectional view illustrating a particular embodiment of a regulator and a shut-off valve of the ink-jet image forming apparatus according to the present general inventive concept.

FIG. 4 illustrates an exemplary embodiment of the regulator and the shut-off valve.

As illustrated in FIG. 4, a shut-off valve 60 is mounted in an upstream side of a regulator 50 in the ink supply passage 25. The shut-off valve 60 includes a valve housing 61, a valve seat 62 mounted in the valve housing 61 and having an orifice 62*a*, an opening/closing member 64 to open or close the orifice 62*a*, and a press member 66 and a lever 67 to press the opening/closing member 64.

The interior of the valve housing 61 is partitioned into an upper space 61*a* and a lower space 61*b*, and the upper space 61*a* and the lower space 61*b* are connected to each other through a passage 61*c*. The valve seat 62 is mounted in the upper space 61*a*, and the orifice 62*a* provided in the valve seat 62 is connected to a connecting tube 29. The connecting tube 29 is also connected to the filter 26 (refer to FIG. 2), so that the ink passing through the filter 26 flows in the upper space 61*a* of the valve housing 61 through the connecting tube 29. The valve seat 62 is covered with a sealing member 63, and the press member 66 is up/down movably mounted at the exterior of the sealing member 63.

The sealing member 63 is made of a rubber material, which can be elastically deformed. An inner space 63*a* defined by the sealing member 63 is connected with the passage 61*c*. Therefore, the ink passing through the orifice 62*a* flows in the inner space 63*a* defined by the sealing member 63, and then flows to the lower space 61*b* of the valve housing 61 through the passage 61*c*. The opening/closing member 64 is coupled to an upper surface of the sealing member 63, so that when the press member 66 moves down, the sealing member 63 becomes elastically deformed and the opening/closing member 64 blocks the orifice 62*a*. A return spring 65 is mounted in the inner space 63*a* defined by the sealing member 63, to elastically support the upper portion of the sealing member 63. When the press member 66 moves upward, the return spring 65 contributes to the return of the sealing member 63 to its original position (i.e., an expanded position).

The lever 67 is pivotably coupled to a hinge shaft 68. The lever 67 pivots by a cam 70, and presses the press member 66. A first end portion of the lever 67 is provided with a press portion 67*a* to press the press member 66, and a second end portion of the lever 67 is elastically supported by a press spring 69. As illustrated in FIG. 4, when the cam 70 pushes down on the second end portion of the lever 67, the pressing force of the press portion 67*a* to the press member 66 is removed, and thus the opening/closing member 64 retracts from the valve seat 62. Thereby, the orifice 62*a* becomes opened.

When the cam 70 rotates to remove the pressing force applied to the second end portion of the lever 67, the second end portion of the lever 67 moves upward by the elastic force of the press spring 69, and the lever 67 pivots so that the press portion 67*a* presses the press member 66. At this time, the sealing member 63 becomes pressed down, and the opening/closing member 64 blocks the orifice 62*a*, thereby intercepting the ink flow.

The regulator 50 includes a valve housing 51 which is connected with the valve housing 61 of the shut-off valve 60 through a passage 51*a*, and a chamber housing 59 connected with the valve housing 51. A valve seat 52 having an orifice 52*a* is provided between the valve housing 51 and the chamber housing 59, and the orifice 52*a* is opened or closed by an opening/closing member 53. The opening/closing member 53 is elastically supported and pressed by a press spring 54, to block the orifice 52*a*. The opening/closing member 53 includes a body 53*a* which blocks the orifice 52*a* when in contact with the valve seat 52, and a protrusion 53*b*, which protrudes into an ink chamber 54*a* of the chamber housing 59 through the orifice 52*a*.

Inside the ink chamber 54*a* are mounted an air bag 55, which communicates with the outside to permit the air flow to/from the outside, and an operating member 56, which moves up and down by the air bag 55. When the air bag 55 is expanded, the operating member 56 moves up, and pushes up the protrusion 53*b*. When the air bag 55 is contracted, the operating member 56 is pushed down by the return spring 57, and returns to its original position. When the operating member 56 moves up and pushes up the protrusion 53*b*, the body 53*a* of the opening/closing member 53 retracts from the valve seat 52, and the orifice 52*a* becomes opened. The ink in the ink chamber 54*a* is supplied to the print head 21 (refer to FIG. 1) through a connecting tube 58.

The above-described shut-off valve 60 and the regulator 50 are exemplary embodiments, and the particular structures thereof can be varied diversely.

As apparent from the above description, the ink-jet image forming apparatus according to the above described embodiments can prevent the ink in the ink tank from flowing to the print head and leaking from the print head even when the regulator is not operated for a long period of time or even when the regulator operates erroneously or is damaged, because the shut-off valve mounted in the ink supply passage connecting the print head and the ink tank intercepts with force the ink flow through the ink supply passage.

Further, the ink-jet image forming apparatus according to the exemplary embodiments of the present general inventive concept can supply the ink to the print head through the ink return passage while blocking the ink supply passage, thereby easily removing foreign substances from the print head by discharging the foreign substances to the outside of the print head together with the ejected ink.

Although embodiments of the present general inventive concept have been shown and described, it would be appreciated by those skilled in the art that changes may be made in this embodiment without departing from the principles and spirit of the general inventive concept, the scope of which is defined in the claims and their equivalents.

What is claimed is:

1. An ink-jet image forming apparatus comprising:

a print head having a plurality of nozzles to eject ink;

an ink tank to store the ink;

an ink supply passage to supply the ink in the ink tank to the print head;

an ink return passage to return the ink in the print head to the ink tank;

a regulator mounted in the ink supply passage to regulate ink flow supplied to the print head;

a shut-off valve including a valve seat having an orifice to connect to a passage at a side of the ink tank and a passage at a side of the regulator, an opening/closing member to open or close the orifice, the shut valve being mounted in the ink supply passage, between the ink tank and the regulator, to intercept ink flow supplied to the regulator; and an ink pump mounted in the ink return passage to forcedly flow the ink in the ink return passage, the ink pump being configured to be driven in forward and reverse directions to change an ink flow direction, wherein when the shut-off valve opens the ink supply passage and the ink pump is driven in the forward direction, the ink circulates between the print head and the ink tank, and wherein the shut-off valve closes when a purging operation of the print head is being performed.

2. The ink-jet image forming apparatus according to claim 1, wherein the print head is positioned at a higher level than a maximum level of the ink stored in the ink tank.

3. The ink-jet image forming apparatus according to claim 1, further comprising:

a filter mounted between the ink tank and the shut-off valve to filter foreign substances included in the ink flowing along the ink supply passage.

4. The ink-jet image forming apparatus according to claim 1, wherein the ink tank is provided with an air vent to introduce outdoor air.

5. The ink-jet image forming apparatus according to claim 1, wherein when the shut-off valve blocks the ink supply passage and the ink pump is driven in the reverse direction, the ink in the ink tank flows to the print head, and the ink in the print head is ejected through the plurality of nozzles, whereby foreign substances existing in the print head are discharged outside together with the ejected ink.

6. The ink-jet image forming apparatus according to claim 1, wherein the ink pump is configured as a rotary pump to rotate in the forward and reverse directions.

7. The ink-jet image forming apparatus according to claim 1, wherein the regulator includes an ink chamber connected with the print head, a valve seat having an orifice connecting the ink chamber and a passage at a side of the shut-off valve, and an opening/closing member to open or close the orifice by moving according to a pressure change in the ink chamber.

8. A method of controlling ink flow in an ink-jet image forming apparatus including a shut-off valve comprising a valve seat having an orifice to connect a passage at a side of the ink tank and a passage at a side of a regulator, an opening/closing member to open or close the orifice, through which ink in an ink tank is supplied to a print head, to intercept ink flow, and an ink pump provided in an ink return passage, through which ink in the print head returns to the ink tank, to forcedly flow the ink, the method comprising:

blocking the ink supply passage by closing the shut-off valve; and discharging foreign substances outside from the print head together with the ejected ink, by driving the ink pump in a reverse direction to forcedly flow the ink in the ink tank to the print head through the ink return passage while regulating a reverse pressure on the ink flow supplied to the print head through the ink supply passage, wherein the shut-off valve closes when a purging operation of the print head is being performed.

9. A method of controlling ink flow in an ink-jet image forming apparatus including a shut-off valve comprising a valve seat having an orifice to connect a passage at a side of the ink tank and a passage at a side of a regulator, an opening/closing member to open or close the orifice, the shut-off valve being provided in an ink supply passage, through which ink in an ink tank is supplied to a print head, to intercept ink flow, and an ink pump provided in an ink return passage, through which ink in the print head returns to the ink tank, to forcedly flow the ink, the method comprising:

opening the ink supply passage by opening the shut-off valve; and circulating the ink between the print head and the ink tank by driving the ink pump in a forward direction, wherein the shut-off valve closes when a purging operation of the print head is being performed by driving the ink pump in a reverse direction.

10. A method of controlling ink flow in an ink-jet image forming apparatus including a print head having a plurality of nozzles to eject ink, an ink tank to store the ink, and an ink supply passage and an ink return passage to connect the print head and the ink tank, and a shut-off valve comprising a valve seat having an orifice to connect a passage at a side of the ink tank and a passage at a side of a regulator, an opening/closing member to open or close the orifice, the method comprising:

blocking the ink supply passage; and discharging foreign substances outside from the print head through the plurality of nozzles by forcedly flowing the ink in the ink tank to the print head through the ink return passage while regulating a reverse pressure on the ink flow supplied to the print head through the ink supply passage, wherein the shut-off valve closes when a purging operation of the print head is being performed.

11. An ink-jet image forming apparatus comprising:

a print head to eject ink;

an ink storage to store the ink;

an ink transportation loop to supply the ink in the ink storage to the print head and to return the ink in the print head to the ink storage;

a regulator mounted in the ink transportation loop to regulate ink flow supplied to the print head from the ink storage;

a shut-off valve mounted in the ink transportation loop between the ink storage and the regulator to intercept ink flow supplied to the regulator; and a reversible ink pump mounted in the ink transportation loop between the print head and the ink storage to forcedly flow the ink from the print head to the ink storage and to forcedly flow the ink from the ink storage to the print head based on a mode of operation of the ink-jet image forming apparatus, wherein when a purging operation of the print head is being performed, the shut-off valve closes, the ink pump is driven in a first direction to flow ink directly from the ink storage to the print head, and pressure of the regulator increases; and when a circulation operation of ink is being performed, the shut-off valve opens, the ink pump is driven in a second direction to flow ink from the ink storage to the print head through the shut-off valve and the reversible ink pump, and pressure of the regulator decreases.

12. The ink-jet image forming apparatus according to claim 11, wherein when a printing operation is being performed, the shut-off valve is in an open state, the ink pump is in a non-operating state, and pressure of the regulator decreases while supplying ink to the print head.

13. The ink-jet image forming apparatus according to claim 11, wherein the regulator comprises a pressure device which opens an orifice between the regulator and the ink storage to allow ink to flow from the ink storage to the regulator while ink also flows from the regulator to the print head during a printing operation, and closes the orifice as the regulator builds up a supply of ink when the printing operation is completed.

14. The ink-jet image forming apparatus according to claim 13, wherein the pressure device comprises:

an airbag that expends when the pressure within the regulator decreases and contracts when the pressure within the regulator increases; and an operation device which opens the orifice when the airbag expands and closes the orifice when the airbag contracts.

15. The ink-jet image forming apparatus according to claim 14, wherein the operation device comprises:

an operation member adjacent the airbag;

an opening/closing member disposed at the orifice;

a return spring disposed between the operation member and the opening/closing member to bias the opening/closing member away from the orifice; and a press spring to press the opening/closing member toward the orifice.

16. The ink-jet image forming apparatus according to claim 1, wherein the regulator includes an ink chamber connected with the print head, a valve seat having an orifice connecting the ink chamber and a passage at a side of the shut-off valve, and an opening/closing member to open or close the orifice by moving according to a pressure change in the ink chamber.

17. The ink-jet image forming apparatus according to claim 16, wherein the opening/closing member of the shut-of value and the open/closing member of the regulator move in a first direction when opening the orifice of the shut-off value and the orifice of the regulator, respectively, and the opening/closing member of the shut-off value and the open/closing member of the regulator move in a second direction opposite the first direction when closing the orifice of the shut-off value and the orifice of the regulator, respectively.

18. The ink-jet image forming apparatus according to claim 17, wherein the opening/closing member and the orifice of the shut-of value, and the opening/closing member and the orifice of the regulator are aligned along the first and second directions.

* * * * *